US005433505A

United States Patent [19]

Coyne et al.

[11] Patent Number: 5,433,505

[45] Date of Patent: Jul. 18, 1995

[54] ADJUSTABLE SEAT AND BACK CUSHION

[75] Inventors: Patrick J. Coyne, Shaker Heights; Paul E. Brokaw, Euclid, both of Ohio

[73] Assignee: Master Manufacturing Co., Cleveland, Ohio

[21] Appl. No.: 259,559

[22] Filed: Jun. 14, 1994

Related U.S. Application Data

[63] Continuation of Ser. No. 868,298, Apr. 19, 1992, abandoned.

[51] Int. Cl.[6] ..... A47C 27/15

[52] U.S. Cl. ..... 297/284.1; 297/284.5; 297/230.14; 297/452.21; 297/452.32; 5/653

[58] Field of Search ..... 297/284.1, 284.3, 284.4, 297/284.5, 230.1, 230.14, 452.21, 452.26, 452.27, 452.30, 452.32; 5/464, 465, 481, 653

[56] References Cited

U.S. PATENT DOCUMENTS

| | | | |
|---|---|---|---|
| Re. 32,734 | 8/1988 | McLeod . | |
| D. 268,976 | 5/1983 | Ross . | |
| D. 279,642 | 7/1985 | Ross . | |
| 1,211,548 | 1/1917 | Courts | 5/465 |
| 1,667,626 | 4/1928 | Epstein . | |
| 1,673,433 | 6/1928 | Wheeler . | |
| 1,982,516 | 11/1934 | Holmested . | |
| 2,291,266 | 7/1942 | Wade . | |
| 2,769,485 | 11/1956 | Shapiro . | |
| 2,905,230 | 9/1959 | Gabriel . | |
| 3,087,172 | 4/1963 | Arno . | |
| 3,103,219 | 9/1963 | Chadner . | |
| 3,118,153 | 1/1964 | Hood . | |
| 3,181,530 | 5/1965 | Storey . | |
| 3,321,241 | 5/1967 | Froelich . | |
| 3,464,754 | 9/1969 | Gottfried . | |
| 3,495,871 | 2/1970 | Rosag et al. | 297/284.5 X |
| 3,534,417 | 10/1970 | Boyles . | |
| 3,608,106 | 9/1971 | Parramon . | |
| 3,610,685 | 10/1971 | Lay . | |
| 3,639,927 | 2/1972 | Munch | 5/464 |
| 3,765,721 | 10/1973 | Watkin . | |
| 3,894,565 | 7/1974 | Conner . | |
| 3,939,508 | 2/1976 | Hall et al. . | |
| 3,974,827 | 8/1976 | Bodeen . | |
| 3,987,507 | 10/1976 | Hall . | |
| 4,080,675 | 3/1978 | Kanowsky et al. . | |
| 4,143,909 | 3/1979 | McFarlin . | |
| 4,335,725 | 7/1982 | Geldmacher . | |
| 4,471,993 | 9/1984 | Watson | 297/460 X |
| 4,534,593 | 8/1985 | Ojala | 297/284.4 |
| 4,592,589 | 6/1986 | Hellwig . | |
| 4,682,818 | 7/1987 | Morell . | |
| 4,706,313 | 11/1987 | Murphy . | |
| 4,718,727 | 1/1988 | Sheppard | 297/452.32 X |
| 4,759,543 | 7/1988 | Feldman . | |
| 4,777,681 | 10/1988 | Luck et al. . | |
| 4,810,034 | 3/1989 | Beier | 297/284 |
| 4,824,169 | 4/1989 | Jarrell | 297/230 |
| 4,959,880 | 10/1990 | Tesch . | |
| 4,960,304 | 10/1990 | Frantz . | |
| 4,975,996 | 12/1990 | Evans et al. . | |
| 5,018,790 | 5/1991 | Jay | 297/284.1 |
| 5,172,439 | 12/1992 | Farley | 5/481 X |

FOREIGN PATENT DOCUMENTS

| | | | |
|---|---|---|---|
| 224294 | 11/1962 | Austria | 5/464 |
| 2812961 | 6/1979 | Germany | 5/464 |

*Primary Examiner*—Peter R. Brown
*Attorney, Agent, or Firm*—Calfee Halter & Griswold

[57] ABSTRACT

An adjustable seat or back cushion to provide comfort and support for a sitting individual has an outer fabric cover with a front panel and a back panel forming an enclosure. The cover has a zippered opening which provides selected access to the enclosure. At least one support pad formed from compressible material with a first predetermined configuration and a first ILD is designed to be inserted through the opening and selectively located in the enclosure adjacent the front panel. A plurality of other support pads also formed of compressible material having at least one other predetermined configuration and ILD different than the configuration and ILD of the first support pad can be inserted through the opening and selectively located between the first support pad and the rear panel. The support pads are located in adjacent, surface-to-surface contact to create a tiered structure within the cushion. The support pads can be arranged and/or rearranged one in front of the other within the cushion to provide a cushion which can be personalized to the particular comfort and support needs of the individual.

20 Claims, 1 Drawing Sheet

ADJUSTABLE SEAT AND BACK CUSHION

This application is a continuation of application Ser. No. 07/868,298, filed on Apr. 14, 1992, abandoned.

FIELD OF THE INVENTION

The present invention generally relates to seat and back cushions, and more particularly to seat and back cushions with inner support pads which can be selectively arranged and/or rearranged within an outer cover to provide a cushion which can be personalized to the particular comfort and support needs of the individual.

BACKGROUND OF THE INVENTION

Maintaining comfort and support for the sitting individual, particularly in the work environment, has been the goal of industrial health practitioners for years. One way of achieving this goal has been through the use of ergonomically designed chairs. These types of chairs attempt to support the individual such that pressure on the pelvic and lumbar regions of the body is reduced—which has been found to increase circulation, require less muscle activity, and generally provide other health benefits. While these types of chairs provide certain benefits in supporting the sitting individual which are typically not found in conventional chairs, ergonomically designed chairs can be relatively expensive, require replacement of chairs previously acquired, and can be limited in flexibility in adjusting to individuals with particular comfort and support requirements.

Another way of achieving proper comfort and support for the sitting individual has been through the use of cushions, and in particular, seat and/or back cushions. For example, back cushions can be attached to the back of the chair to provide a certain amount of comfort and support for the lumbar region of the individual; while seat cushions can be placed on the seat of a chair to provide comfort and support for both the lumbar and pelvic regions of the individual. The seat and back cushions can be relatively less expensive than ergonomically designed chairs, can be used with existing chairs, and in some cases allow a certain amount of adjustment to compensate for the particular comfort and support requirements of the individual.

Seat and back cushions of this type have been developed to correct posture or muscular imbalances, to provide support to compensate for a poorly-designed chair, and/or to provide a favorable physiological lumbar lordosis for the sitting individual. "Lumbar lordosis" is the slight forward curvature of the spine in the lumbar region achieved during forward tilt sitting. This position minimizes the pressure on the invertebral discs, requires less muscle activity (e.g., diaphragm function) than the Kyphotic ("hunched-over") posture, and minimizes stress on the posterior lumbar ligaments.

For example, one type of back cushion is shown in Feldman, U.S. Pat. No. 4,759,543; and Beier, U.S. Pat. No. 4,810,034. These references disclose orthopedic devices attached to or leaning against the back of the chair to support the lumbar region of the spine when a person is in a sitting position. These orthopedic devices have inflatable air chambers which can be inflated/deflated depending upon the desired lumbar support.

Another type of back cushion is shown in Bodeen, U.S. Pat. No. 3,974,827 ("Bodeen"). This reference discloses a cushion having a backrest and a lumbar support cushion enclosed within a cover. The lumbar support cushion can be adjusted relative to the backrest (or removed and replaced) to accommodate the physical structure of different individuals.

Still another type of back cushion is shown in Watson, U.S. Pat. No. 4,471,993 ("Watson"). The Watson device includes an orthopedic-shaped structural support formed of thermoplastic material and covered by a fabric enclosure. The Watson device includes straps which allow the cushion to be attached to the back of a chair or seat.

On the other hand, one type of seat cushion is shown in Hellwig, U.S. Pat. No. 4,592,589 and Frantz, U.S. Pat. No. 4,960,304. These references disclose a seat cushion having inflatable enclosures which can be inflated/deflated depending upon the necessary support for the pelvis and the lumbar region.

Although the aforementioned seat and back cushions provide a certain amount of flexibility in adjusting the profile of the cushion, there is a continued need for relatively inexpensive seat and-back cushions which can be simply and easily adjusted to provide a cushion which can be personalized to the particular comfort and support needs of the individual.

SUMMARY

The present invention provides a new and useful adjustable seat and back cushion which provides comfort and support for the sitting individual. The adjustable cushion includes a plurality of inner support pads which can be selectively arranged and/or rearranged within an outer cover to provide a cushion with a predetermined geometric profile. According to one aspect of the invention, the cushion can be used as a back cushion to provide lumbar support for the sitting person, while according to another aspect of the invention, the cushion can be used as a seat cushion to provide lumbar and pelvic support, and in particular, to achieve lumbar lordosis.

According to either aspect of the invention, the adjustable cushion includes an outer fabric cover folded lengthwise to form a front panel and a back panel. The front panel and back panel normally extend in proximate relation to each other and are connected along their open sides and front with a fastener such as a zipper.

The plurality of support pads for the cushion are formed of generally flat, compressible material and are designed to be inserted within the zippered opening and selectively located between the front panel and the back panel of the cover. More particularly, in the case of the seat cushion, a first pair of support pads are designed to be inserted into the cover and located adjacent to the front panel. A plurality of other support pads can be inserted into the cover between the first pair of support pads and the back panel. The other support pads have a configuration (e.g., a length) which is different from the configuration of the first pair of support pads to create a tiered structure within the cushion. The tiered structure of the pads provides a seat cushion with a predetermined geometric profile for supporting the sitting individual.

The plurality of other support pads can be arranged and/or rearranged one in front of the other within the cover to adjust the tiered structure by removing the pads through the zippered opening and reinserting the pads in a different arrangement, by inserting more (or few pads within the cushion, or by manipulating (e.g., folding over or rolling up) the pads. By adjusting the tiered structure of the pads, the geometric profile of the cushion can be adjusted such that lumbar lordosis is achieved for a particular individual when the individual sits on the cushion. Moreover, the support pads can be introduced into the cover periodically as the individual becomes comfortable and accustomed to the geometric profile of the cushion. In any case, it is preferred that the pair of support pads adjacent the front panel have a predetermined firmness which provides a substantially smooth and continuous outer surface for the sitting individual, regardless of the arrangement of the other support pads.

In the case of the back cushion, a first support pad can be inserted between the front and back panels and located adjacent to the front panel of the outer fabric cover. A plurality of other support pads can be inserted into the cover between the first support pad and the back panel. The other support pads have a configuration (e.g., a length) which is different from the configuration of the first support pad to provide a tiered structure within the back cushion. The tiered structure of the support pads provides a back cushion with a predetermined geometric profile for supporting the sitting individual. As with the seat cushion, the other support pads within the back cushion can be selectively arranged and/or rearranged one in front of the other within the cover to adjust the geometric profile of the cushion depending on the support and comfort needs of the individual. Additionally, the first support pad adjacent the front panel has a predetermined firmness which provides a substantially smooth and continuous outer surface for the individual, regardless of arrangement of the other support pads.

Both the seat and back cushion can be secured to a chair using hook and loop fasteners or other fastening means. For example, for the back cushion, strips of velcro can be attached to the back panel, while other strips of velcro (or fabric) can be attached to the back of the chair to allow the back cushion to be easily attached and/or detached from the back of the chair. In the case of the seat cushion, velcro strips can be attached to the back panel to allow the seat cushion to be easily attached and/or detached from the seat of the chair.

Accordingly, it is a basic object of the present invention to provide an adjustable cushion which provides comfort and support for a sitting individual.

Another object of the invention is to provide a low-cost seat or back cushion which has a geometric profile that can be simply and easily adjusted depending upon the particular comfort and support needs of the individual.

It is still another object of the present invention to provide a cushion such as a seat cushion which can be periodically adjusted as the sitting individual becomes comfortable and accustomed to the geometric profile of the cushion until lumbar lordosis is achieved.

Further objects of the present invention will become apparent from the following detailed description and accompanying drawings which form a part of the specification.

DETAILED DESCRIPTION OF THE PREFERRED EMBODIMENT

Figure 1:
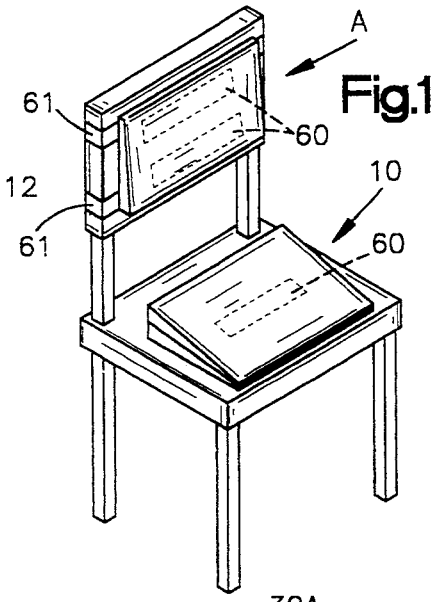
FIG. 1 is a perspective view of a chair having a seat cushion and a back cushion constructed according to the principles of the present invention attached thereto.

Referring to the drawings, and initially to FIG. 1, a chair is illustrated generally at A for providing support for a sitting individual. A seat cushion, indicated generally at 10, and a back cushion, indicated generally at 12, are attached to the chair to provide comfort and support for a sitting individual, as will be described herein in more detail. It must be noted that the chair is shown for illustration purposes only, and the present invention is not limited to a particular type of chair or chair design. In fact, the present invention can be used in any situation where it is necessary to support an individual in a sitting position, for example, in an automobile or an airplane, or on a couch or bench. These variations should become apparent to one skilled in the art upon reading the present specification.

Figure 2:
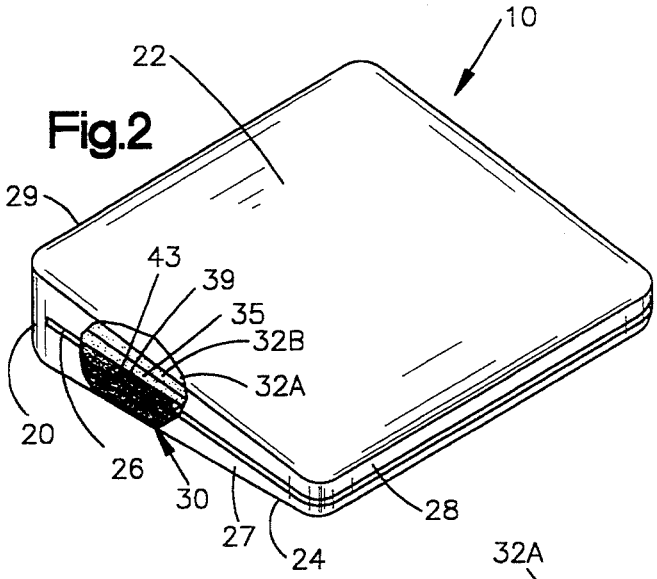
FIG. 2 is a partial sectional perspective view of the seat cushion of FIG. 1.

Referring now to FIG. 2, the seat cushion 10 of the present invention includes an outer fabric cover 20 preferably formed in one piece and folded lengthwise to form a front panel 22 and a back panel 24. The seat cushion is also shown as having sides 27, front 28 and back 29. A fastening means such as a zipper 26 or velcro fasteners (not shown) extends along the sides 27 and front 28 on each panel and is designed to interconnect the periphery of the panels to define an enclosure. The zipper 26 can be any commercially available type that is sewn or otherwise attached to the panels and which allows selected access to the enclosure. It will also be understood that the cover can also be formed in a plurality of pieces sewn or otherwise fastened together along one or more sides or edges, and/or that the zipper (or other fastening means) could extend completely around the sides and edges of the front and back panels, or alternatively, only partially along a side or edge. These variations should also be apparent to those skilled in the art.

A plurality of support pads, indicated generally at 30, can be introduced within the enclosure to create a seat cushion with a predetermined geometric profile for support and cushioning of a sitting individual. The plurality of support pads are preferably formed from compressible material, for example open-cell foam, however other material is certainly possible. Each support pad is generally flat, and can be manufactured in sheets using conventional techniques known to those skilled in the art, and cut to appropriate dimensions to fit within the outer cover of the cushion.

Figure 3A:
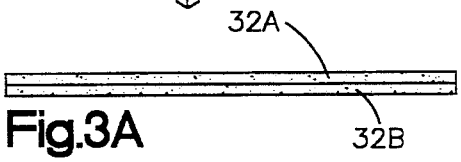
FIG. 3A is a schematic illustration of a first step for assembling the seat cushion of FIG. 1, wherein a first pair of support pads are introduced into the cushion.
Figure 3B:
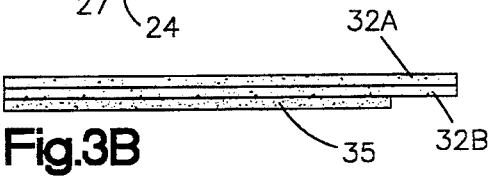
FIG 3B is a schematic illustration of a subsequent step for assembling the seat cushion of FIG. 1, wherein a third support pad is introduced into the cushion.
Figure 3C:
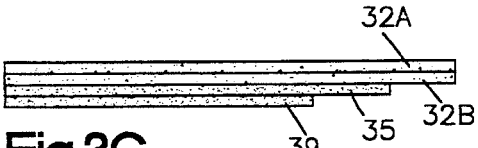
FIG. 3C is a schematic illustration of yet a subsequent step in assembling the seat cushion of FIG. 1, wherein a fourth support pad is introduced into the cushion.
Figure 3D:
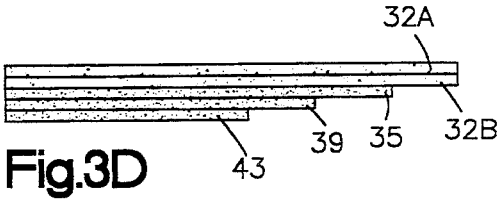
FIG. 3D is a schematic illustration of still another step in assembling the seat cushion of FIG. 1, wherein a fifth pad is introduced into the cushion.

The support pads can be introduced and selectively arranged (and/or rearranged) within the cushion to create the predetermined geometric profile. For example, as illustrated in FIG. 3A, a first and second support pad 32A, 32B, can be inserted within the cushion and located one in front of the other adjacent to the inside surface of the front panel 22 (FIG. 2). A third pad 35 (FIG. 3B) can be located between the first and second cushions 32A, 32B and the inside surface of the rear panel 24 (FIG. 2) of the cushion. A fourth pad 39 (FIG. 3C) can then be located between the third pad 35 and the rear panel 24 of the cushion. Finally, a fifth pad 43 (FIG. 3D) can be located between the fourth pad 39 and the rear panel 24 of the cushion. The support pads are arranged one in front of the other in surface-to-surface contact.

As indicated previously, it is preferred that the support pads have configurations which create a tiered structure within the cover when arranged in the above-described manner. More particularly, it is preferred that the third, fourth and fifth support pads, 35, 39, 43, have slightly smaller configurations (e.g., lengths) than the first two support pads 32A, 32B. It is also preferred that the ends of the pads are arranged flush with each other (see, e.g., FIG. 3D) adjacent the rear of the cushion after being inserted into the cover. When the support pads are arranged in this manner, the pads create a tiered structure within the cushion, which in turn provides a cushion with a predetermined geometric profile.

As an example, for a seat cushion that is approximately 18 inches wide×18 inches long, it is preferred that the first and second support pads 32A, 32B, are about 17 inches wide and 17 inches long. The third support pad 35 is preferably about 17 inches wide and 13 inches long; while the fourth support pad 39 is preferably about 17 inches wide and 10 inches long. Finally, the fifth support pad 43 is preferably about 17 inches wide and 7 inches long. Each support pad preferably has a thickness of about 7/16 of an inch. However, the particular configurations described above are only exemplary in nature, and it is also possible that the seat rest can be used with pads of other configurations, or that fewer (or more) pads of the type described above can be introduced within the cushion to create a different tiered structure. This invention is intended to encompass all such variations which should be apparent to those skilled in the art.

Figure 3E:
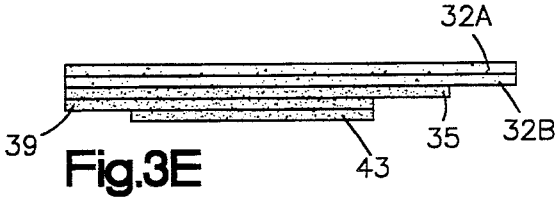
FIG. 3E is a schematic illustration of a different arrangement of support pads for the seat cushion of FIG. 1.

When the support pads are arranged in the above-described manner within the cushion, the geometric profile of the cushion is angled downwardly toward the front of the cushion. The seat cushion is then located on the chair such that the back panel contacts the top surface of the chair and the cushion is angled downwardly toward the front of the chair (see, e.g., FIG. 1). The front panel of the cushion provides a seat for the individual. When the individual sits on the cushion, the individual is supported in the predetermined geometric profile of the cushion. To prevent the sitting individual from sliding forward on the cushion, the outer cover of the cushion can be formed from rough fabric, or one of the pads (e.g., pad 43) can be moved forwardly within the seat cushion, as illustrated in FIG. 3E.

The support pads for the cushion can be arranged and/or rearranged (as described above) to support the sitting individual such that an angle of approximately 100 degrees is created between the torso and the legs. Such an angle achieves lumbar lordosis which provides the important health benefits described previously. Moreover, since the support pads and the outer cover are formed from generally flexible material, the cushion has a tendency to mold to the surface of the chair and can "wrap around" the front edge of the chair to provide increased circulation for the legs. Therefore, the arrangement of pads within the cushion provides a means for achieving proper lumbar lordosis to support the sitting individual at a physiologically correct angle.

It is also preferred that each of the support pads 32A, 32B, 35, 39 and 43, have different Indent Load Deflections (ILD's), or firmness. More particularly, it is preferred that the first and second support pads 32A, 32B, which are adjacent the front panel 22, have an ILD which is less than (i.e., less "firm" than) the ILD for the remaining support pads. For example, the first and second support pads 32A, 32B can have an ILD of about 50, while the remaining support pads 35, 39, and 43 can each have an ILD of about 90. By forming the first and second support pads in this manner, these pads mask any discontinuities in the pad arrangement by providing a substantially smooth and continuous outer surface for the individual, regardless of the arrangement of the remaining support pads in the cover.

It should also be apparent to those skilled in the art that the support pads described herein can be simply and easily arranged and/or rearranged within the cushion by unzipping the opening, withdrawing the pads through the opening, and thereafter rearranging and reinserting the pads through the opening to provide a different tiered structure, and hence, a different geometric profile for the cushion.

Some of the pads might also be manipulated into different forms before reinsertion into the cushion. For example, one (or more) pads can be folded over or rolled into a ball to provide support for a particular portion of the lumbar or pelvic region. The other pad arrangements might (or might not) provide the same forward tilt sitting position, however they can also provide other health benefits which should be apparent to those skilled in the art. In any case, the pads can be simply and easily arranged within the cover to provide a cushion which can be individualized to a particular individual's comfort and support needs.

When an individual is initially attempting to achieve lumbar lordosis (i.e., forward tilt sitting), the support pads can be periodically introduced while the individual becomes comfortable with and accustomed to the geometric profile of the cushion. For example, the individual can locate the first two support pads within the cushion (see, e.g., FIG. 3A) to achieve a raised, but relatively flat surface for sitting. The individual can then become comfortable with and accustomed to this arrangement of support pads. Subsequently, additional pads may be introduced within the cushion, for example as shown in progression in FIGS. 3B, 3C and 3D, until a predetermined geometric profile is achieved. As indicated previously, when the individual desires to increase the angle of the cushion, the support pads can be simply and easily inserted through the zippered opening in the seat cushion to achieve the predetermined geometric profile. During this process, the chair might have to be adjusted such that the person s feet remain relatively flat on the floor to prevent the person from sliding forward on the cushion.

Figure 4:
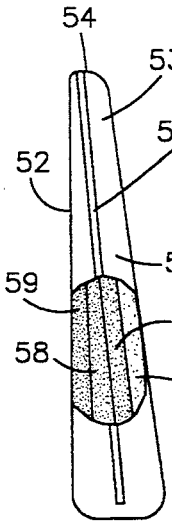
FIG. 4 is a partial sectional side view of the back rest of FIG. 1.

The back cushion 12 is similar in construction to the seat cushion 10. More particularly, referring now to FIG. 4, the back cushion can also have an outer fabric cover 49 formed in one piece and folded lengthwise to form a front panel 50 and a back panel 52. The front and back panels can also be interconnected along the sides 53 and front 54 by a zipper 55 or other fastening means. As before, the zipper 55 provides selected access to the enclosure formed by the front and back panels.

A plurality of support pads can also be located within the back cushion in a tiered structure to provide a cushion with a predetermined geometric profile in the same manner as described previously. Each of the pads for the back rest can also be generally flat and be formed from compressible material e.g., open-cell foam, using techniques known to those skilled in the art.

Figure 5A:
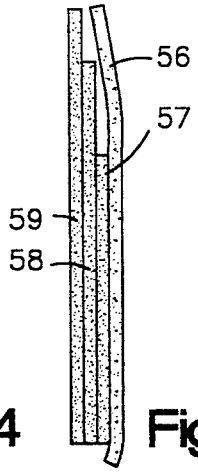
FIG. 5A is a schematic illustration of a first arrangement support pads for the back rest of FIG. 1.

An exemplary arrangement of support pads for the back rest is schematically illustrated in FIG. 5A. In particular, a first support pad 56 can be located within the enclosure adjacent the front panel 50 (FIG. 4), while a second pad 57, a third pad 58, and a fourth pad 59 can be located between the front pad 56 and the rear panel 52. The support pads 56–59 can have different configurations (e.g., lengths) and different ILDs, however it is preferred that the first pad 56 has an ILD which is greater (i e., "firmer") than the ILD of the other pads to provide a substantially smooth and continuous surface for the sitting person, regardless of the arrangement of the remaining support pads 57, 58, 59.

As an example, for a back rest of approximately 14 inches wide×8 inches long, it is preferred that a first pad of about 14 inches wide×7 inches long, a second pad of about 14 inches wide×6½ inches long, a third pad of about 14 inches wide×5½ inches long, and a fourth pad of about 14 inches wide×4½ inches long be introduced through the zippered opening and arranged within the enclosure in a tiered structure. Each pad can have a thickness of about 0.5 inches. The ILD of pad 56 is preferably about 50, while the ILD of pads 57–59 is about 30. It is again noted that the particular configurations described above are only exemplary in nature, and other variations should be apparent to those skilled in the art.

In any case, the support pads provide a tiered structure which creates a back cushion with a predetermined geometric profile. As with the seat cushion, the geometric profile of the back cushion can be simply and easily adjusted depending on the comfort and support needs of the individual by arranging and/or rearranging the pads within the cushion.

Figure 5B:
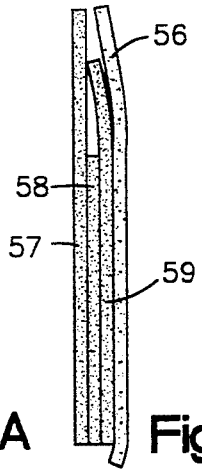
FIG. 5B is a schematic illustration of another arrangement of support pads for the back rest of FIG. 1.
Figure 5C:
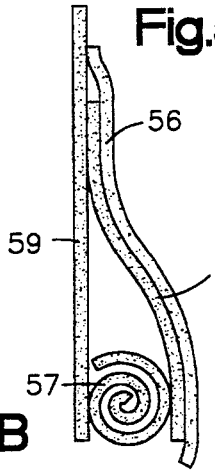
FIG. 5C is a schematic illustration of yet another arrangement of support pads for the back rest of FIG. 1 with one support pad in a rolled up configuration.

For example, another arrangement of the support pads 56–59 for the back rest 12 is illustrated in FIG. 5B. In this illustration, pads 56–59 are rearranged to provide a seat back cushion with substantially the same geometric profile as in the first back cushion, but with the pads in a different arrangement. This different arrangement might be used to overcome a pressure point, for example. Still further, another arrangement of pads is illustrated in FIG. 5C. In this illustration, pad 57 is manipulated into a different shape other than its natural shape (e.g., rolled up) to provide support for a particular portion of the lumbar region. Other arrangements of support pads should be apparent to those skilled in the art.

Accordingly, for either the seat cushion or back cushion described above, the cushions can be simply and easily adjusted to provide a predetermined geometric profile depending upon the comfort and support needs of the individual. Moreover, the support pads can be periodically introduced into the cushion as the individual becomes comfortable with and accustomed to the cushion (particularly in the case of the seat cushion), until a desired geometric profile is achieved.

To attach either of the above cushions to a chair, fastening means such as hook and loop fasteners (e.g., "Velcro") on straps 60 (shown in phantom in FIG. 1), can be attached (e.g. sewn or adhesively secured) to the outer surface of the back panel of the seat or back cushion. The cushion can then be simply and easily attached/removed and/or repositioned on the chair. Additional hook and loop fasteners on straps 61 can be provided around the seat back if necessary to support the back cushion.

The principles, preferred embodiments, and modes of operation of the present invention have been described in the foregoing specification. The invention which is intended to be protected herein should not, however, be construed to the particular form described as it is to be regarded as illustrative rather than restrictive. Variations and changes may be made by those skilled in the art without departing from the spirit of the present invention. Accordingly, the foregoing detailed description should be exemplary in nature and not as limiting as to the scope and spirit of the invention set forth in the appended claims.

What is claimed is:

1. A portable cushion designed to be used in conjunction with a seating structure by placing the cushion on the seating structure to provide support for an individual sitting on the seating structure, the cushion comprising:

an outer cover having a front panel and a back panel which at least partially define an enclosure, said outer cover having an opening which provides access to the enclosure, a first generally rectangular shaped support pad formed of compressible material and having a first size, said first support pad being located in the enclosure between said front panel and said back panel, and a plurality of other generally rectangular shaped support pads formed of compressible material, at least one of said other support pads having a size different from the size of said first support pad, said other support pads being located one in front of the other between said first support pad and said back panel to impart a geometric profile to the cushion, said first support pad and said other support pads having a configuration which enables said first support pad and said other support pads to be removed through said opening and selectively manually rearranged one in front of the other and reinserted through said opening to allow the geometric profile of the cushion to be adjusted by the individual without altering the seating structure;

wherein at least one of said other support pads is formed of a material which can be manually manipulated into a geometric profile different than the natural geometric profile of said at least one of said other support pads.

2. A cushion as in claim 1, wherein each of said first support pad and said other support pads has a polygonal shape in top plane view with a width and a length, the width of said other support pads being the same as the width of said first support pad and the length of said other support pads being less than the length of said first support pad.

3. A cushion as in claim 2 wherein each of said other support pads has a common thickness.

4. A cushion as in claim 2, wherein each of said first support pad and said other support pads is generally flat.

5. A cushion as in claim 2, wherein said first support pad is located adjacent said front panel and has a configuration and a thickness which provides the cushion with an outer surface which is generally smooth and continuous to an individual sitting on the seating structure regardless of the arrangement of said other support pads.

6. A cushion as in claim 5, wherein said first support pad is formed of a material having a first ILD and said other support pads are formed of a material having a second ILD different than said first ILD, the ILD of said first support pad being chosen so as to provide said front panel with a substantially smooth and continuous outer surface.

7. A cushion as in claim 6, further including a second support pad formed of compressible material and having a common configuration as said first support pad, said second support pad being located in the enclosure adjacent said first support pad, said second support pad being formed of a material having an ILD chosen so as to provide said front panel with a substantially smooth and continuous surface.

8. A cushion as in claim 6, wherein said first ILD of said first support pad is less than said second ILD of said other support pads.

9. A cushion as in claim 8, wherein said first ILD is 50 and said second ILD is 90.

10. A cushion as in claim 6, wherein said first ILD of said first support pad is greater than said second ILD of said other support pads.

11. A cushion as in claim 10, wherein said first ILD is 50 and said second ILD is 30.

12. A cushion as in claim 1 wherein said back panel of said outer cover includes a fastening device for removably attaching the cushion to the seating structure.

13. A cushion as in claim 1, wherein said opening in said outer cover includes a closure device.

14. A cushion as in claim 1, wherein said outer cover is formed in one piece and folded in half to create said front panel and said back panel.

15. A cushion as in claim 1, wherein the cushion has a configuration which can be located on the seat of the seating structure for supporting the lumbar and pelvic regions of the individual when the individual is sitting on the seating structure.

16. A cushion as in claim 1, wherein the cushion has a configuration which can be located against the back of the seating structure to support the lumbar region of the individual when the individual is sitting on the seating structure.

17. The portable cushion of claim 1 wherein at least one of said other support pads is formed of a material which can be rolled up.

18. An assembly of elements for use in forming a seat or back cushion, comprising:

an outer cover having a front panel and a back panel which at least partially define an enclosure with an opening, a plurality of support pads formed of compressible material designed to be introduced through the opening in the cover and selectively located between said front and rear panel of said cover, said plurality of support pads including at least one support pad having a first configuration and at least two other support pads having configuration different from said first configuration to create a tiered structure in said cover, said other of support pads also being selectively arrangeable and rearrangeable one in front of the other to create a different tiered structure, wherein each of said plurality of support pads has a polygonal configuration, at least two of said support pads having different polygonal configurations, and wherein one of said other support pads is formed of a material which can be manually manipulated into a geometric profile different than a geometric profile of another said other support pads.

19. An assembly of elements as in claim 1, wherein each of said support pads is generally flat.

20. The assembly of claim 18 wherein said support pads are formed of a material which can be rolled up.

* * * * *